US012742452B2

(12) United States Patent
LeCompte

(10) Patent No.: US 12,742,452 B2
(45) Date of Patent: Sep. 22, 2026

(54) ELECTRICAL SPRAYER

(71) Applicant: MMLJ, Inc., Houston, TX (US)

(72) Inventor: Benjamin LeCompte, Houston, TX (US)

(73) Assignee: MMLJ, INC, Houston, TX (US)

( * ) Notice: Subject to any disclaimer, the term of this patent is extended or adjusted under 35 U.S.C. 154(b) by 361 days.

(21) Appl. No.: 18/335,122

(22) Filed: Jun. 14, 2023

(65) Prior Publication Data

US 2023/0400025 A1 Dec. 14, 2023

Related U.S. Application Data

(60) Provisional application No. 63/366,344, filed on Jun. 14, 2022.

(51) Int. Cl.

| | |
|---|---|
| ***F04B 49/20*** | (2006.01) |
| ***F04B 35/04*** | (2006.01) |
| ***F04B 49/06*** | (2006.01) |
| ***F04B 49/08*** | (2006.01) |
| ***F04C 28/08*** | (2006.01) |

(52) U.S. Cl.

CPC ..... *F04B 49/20* (2013.01); *F04B 35/04* (2013.01); *F04B 49/065* (2013.01); *F04B 49/08* (2013.01); *F04C 28/08* (2013.01); *F04B 2203/0207* (2013.01); *F04B 2203/0209* (2013.01); *F04C 2210/1005* (2013.01); *F04C 2270/025* (2013.01); *F04C 2270/035* (2013.01); *F04C 2270/0525* (2013.01); *F04C 2270/44* (2013.01)

(58) Field of Classification Search

CPC .. F04B 35/04; F04B 49/06–065; F04B 49/08; F04B 49/20; F04B 2203/0207; F04B 2203/0209; F04C 28/08; F04C 2210/1005; F04C 2270/025; F04C 2270/035; F04C 2270/0525; F04C 2270/44; B05B 7/0025

See application file for complete search history.

(56) References Cited

U.S. PATENT DOCUMENTS 5,320,280 A * 6/1994 Murphy ..... B05B 7/24 200/81.9 R
2007/0177983 A1* 8/2007 Levan ..... F04B 49/022 417/19

(Continued)

FOREIGN PATENT DOCUMENTS

AU 2006341531 A1 * 12/2007 ..... B25C 1/06
CN 108138757 A * 6/2018 ..... F04C 28/08

(Continued)

*Primary Examiner* — Alexander B Comley
(74) *Attorney, Agent, or Firm* — Shannon Warren

(57) ABSTRACT

A variable air compressor assembly is provided for selectively generating compressed air using a compressor driven by an electric motor. The assembly includes a controller, an air intake, the compressor, the electric motor, a belt drive assembly, an air outlet, a power source, and a device application. The device application receives sensor data from an RPM sensor, a motor load sensor, a pressure sensor, and an air flow sensor, and generates a control signal to regulate operation of the compressor, the electric motor, and the belt drive assembly according to a power management system. This configuration enables adjustment of motor speed and torque to achieve desired air pressure and flow characteristics.

11 Claims, 6 Drawing Sheets

(56) References Cited

U.S. PATENT DOCUMENTS

| | | | | |
|---|---|---|---|---|
| 2011/0206538 | A1* | 8/2011 | Yokota | F04B 49/065 417/1 |
| 2017/0209880 | A1* | 7/2017 | Carideo | F04B 49/08 |
| 2018/0056311 | A1* | 3/2018 | Miller | B05B 12/1445 |
| 2019/0257306 | A1* | 8/2019 | Blundell | F04B 49/20 |
| 2019/0263363 | A1* | 8/2019 | Mcintyre | F04B 49/065 |
| 2021/0039121 | A1* | 2/2021 | Carideo | F04B 35/04 |

FOREIGN PATENT DOCUMENTS

| | | | | | |
|---|---|---|---|---|---|
| CN | 215805014 | U | * | 2/2022 | F04B 39/00 |
| EP | 3236071 | B1 | * | 2/2020 | F04B 49/06 |
| JP | 2003140752 | A | * | 5/2003 | |
| JP | 2005214137 | A | * | 8/2005 | |
| JP | 2005226538 | A | * | 8/2005 | |
| JP | 3891261 | B2 | * | 3/2007 | |
| JP | 4009950 | B2 | * | 11/2007 | |
| JP | 2011021569 | A | * | 2/2011 | |
| KR | 102404201 | B1 | * | 6/2022 | F04B 49/06 |
| WO | WO-2016098186 | A1 | * | 6/2016 | F04B 49/022 |

* cited by examiner

ELECTRICAL SPRAYER

CROSS-REFERENCE TO RELATED APPLICATIONS

This application claims benefit to at least these U.S. Pat. No. 11,285,580, 9,844,851, 9,849,560, 10,569,386, and 10,449,657.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

No prior art is known to the Applicant.

BRIEF SUMMARY OF THE INVENTION

A variable air compressor assembly for selectively generating a compressed air with a compressor and an electric motor while monitoring an RPM sensor, a motor load sensor, a pressure sensor and an air flow sensor and modifying a control signal for said compressor, said electric motor and a belt drive assembly is disclosed. Comprising said variable air compressor assembly comprises a controller, an air intake, said compressor, said electric motor, said belt drive assembly, an air outlet, a power source and a device application. Said device application receives of a sensor data from a portion of said RPM sensor, said motor load sensor, said pressure sensor and said air flow sensor and generates said control signal to control said compressor, said electric motor and said belt drive assembly according to a power management system in said device application. Said power source is connected to said electric motor and provides necessary power for operation of said variable air compressor assembly. Said compressor mechanically connected to said electric motor with said belt drive assembly and configured to output said compressed air. Wherein, said variable air compressor assembly is configured to selectively adjust the volume and pressure of the air output by modulating a power input from the said electric motor to the said compressor based on the input parameters, the modulation achieved through adjustments in the speed and torque of said electric motor as commanded by said software controller application within the controller.

A method for controlling said compressor, the method comprising the steps of: providing said variable air compressor assembly comprising said electric motor, a power source, said compressor, and a controller integrated with a software controller application. Receiving input parameters related to a desired volume and pressure of the air output from a user or system. Modulating a power input from the said electric motor to the said compressor based on the input parameters, the modulation achieved through adjustments in the speed and torque of the said electric motor as commanded by the software controller application within said controller. Thereby selectively adjusting the volume and pressure of the air output from the said compressor assembly.

Said variable air compressor assembly for selectively generating said compressed air with said compressor and said electric motor while monitoring said RPM sensor, said motor load sensor, said pressure sensor and said air flow sensor and modifying said control signal for said compressor, said electric motor and said belt drive assembly is disclosed. Comprising said variable air compressor assembly comprises said controller, said air intake, said compressor, said electric motor, said belt drive assembly, said air outlet, said power source and said device application. Said device application receives said of a sensor data from a portion of said RPM sensor, said motor load sensor, said pressure sensor and said air flow sensor and generates said control signal to control said compressor, said electric motor and said belt drive assembly according to said power management system in said device application. Said power source is connected to said electric motor and provides necessary power for operation of said variable air compressor assembly. Said compressor mechanically connected to said electric motor with said belt drive assembly and configured to output said compressed air. Wherein, said variable air compressor assembly is configured to selectively adjust the volume and pressure of the air output by modulating a power input from the said electric motor to the said compressor based on the input parameters, the modulation achieved through adjustments in the speed and torque of said electric motor as commanded by said software controller application within the controller. A blasting system connected to the output of the said variable air compressor assembly to receive a portion of said compressed air. Said blasting system further comprising a blaster trigger having a trigger sensor for sensing a state of said blaster trigger. Said blaster trigger configured with multiple settings reflecting operational parameters of said blasting system. Said of a sensor data of said trigger sensor of said blaster trigger are communicated back to said device application. Wherein upon reception of said of a sensor data of said trigger sensor, said device application is configured to dynamically modify an air pressure and an air flow rate of said compressor by modifying a portion of said belt drive assembly, an RPM, and a torque on said electric motor. Said air pressure and said air flow rate of said compressed air from the said compressor are configured by said device application to comply with the operational parameters as specified by said device application. Said pressure sensor configured to measure the pressure (PSI) of the said compressed air from said compressor. Said air flow sensor configured to measure the flow rate of the said compressed air from said compressor. Wherein, the measurements from said pressure sensor and said pressure sensor are fed back to said controller to facilitate real-time adjustments of the speed and torque of said electric motor, thereby achieving precise control over the pressure and flow rate of the air output. Said power management system within said controller, configured to adjust the consumption of power and power ratios between the said electric motor and the said compressor based on the operational phase of the system, the operational phases being a ramp up phase, a maintain phase and a ramp down phase. Wherein, during said ramp up phase, said power management system allocates more power to the said electric motor to quickly achieve the desired speed and torque. During said maintain phase, said power management system balances the power between the said electric motor and the said compressor based on the stable power demands. During said ramp down phase, said power management system reduces power to the said electric motor gradually to bring the system to a stop, thereby minimizing wear on the components. Wherein, the operational phase can be manually set in said controller or programmatically set based on usage patterns detected by said controller, thus enhancing the efficiency, sustainability, and lifespan of the said variable air compressor assembly.

DETAILED DESCRIPTION OF THE INVENTION

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
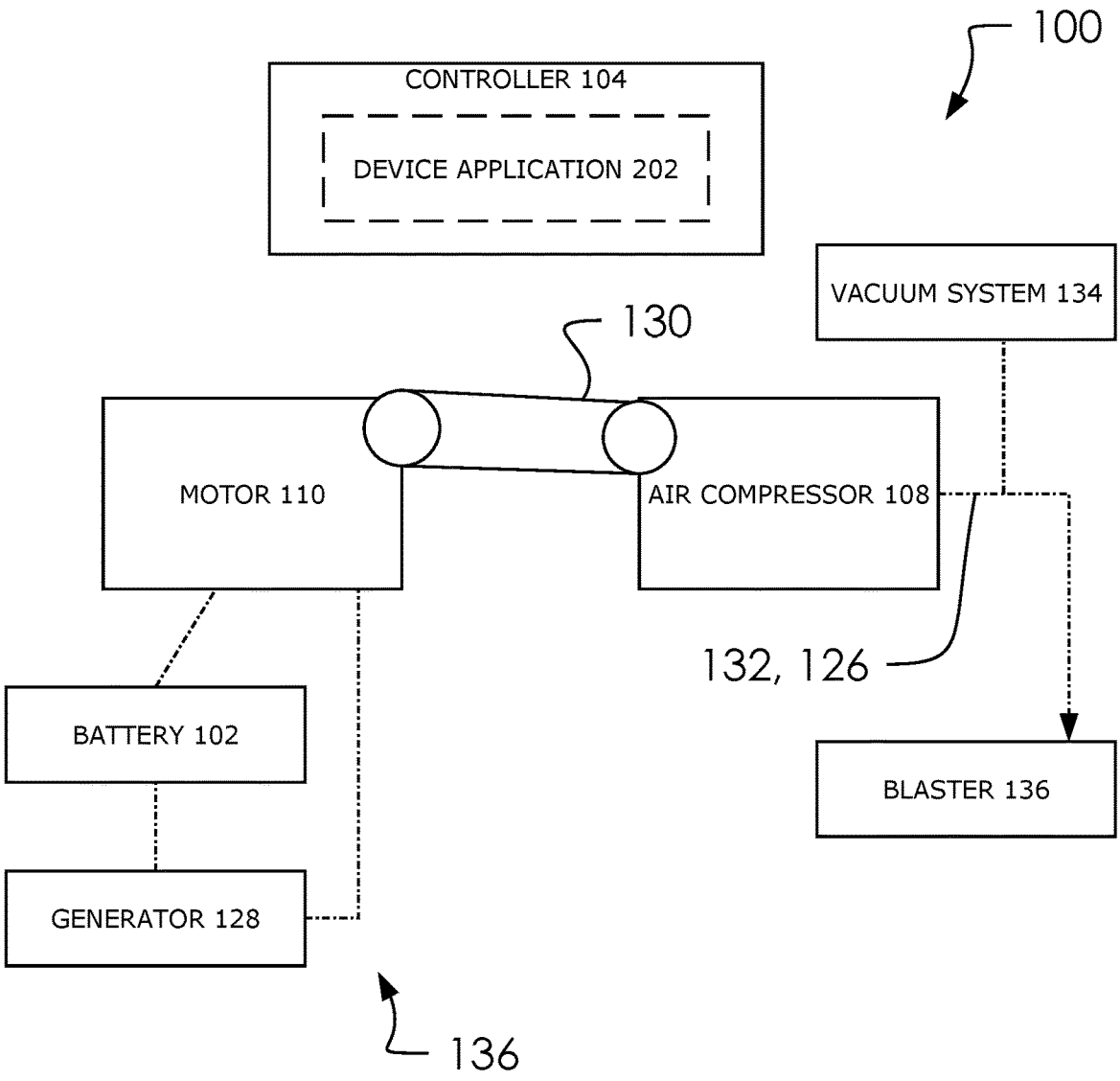
FIG. 1 illustrates a schematic diagram illustrating an overview of a variable air compressor assembly 100.

FIG. 1 illustrates a schematic diagram illustrating an overview of a variable air compressor assembly 100.

In one embodiment, said variable air compressor assembly 100 can comprise a battery 102, a controller 104, an air intake 106, a compressor 108, an electric motor 110, a generator 128, a belt drive assembly 130, an air outlet 132, a vacuum assembly 134, and a blasting system 136.

Said variable air compressor assembly 100 can receive a power source 136 from either said battery 102 or said generator 128, as discussed herein.

Said compressor 108 can receive energy from said belt drive assembly 130 and air from said air intake 106, and create a compressed air 126 at said air outlet 132.

Figure 2A:
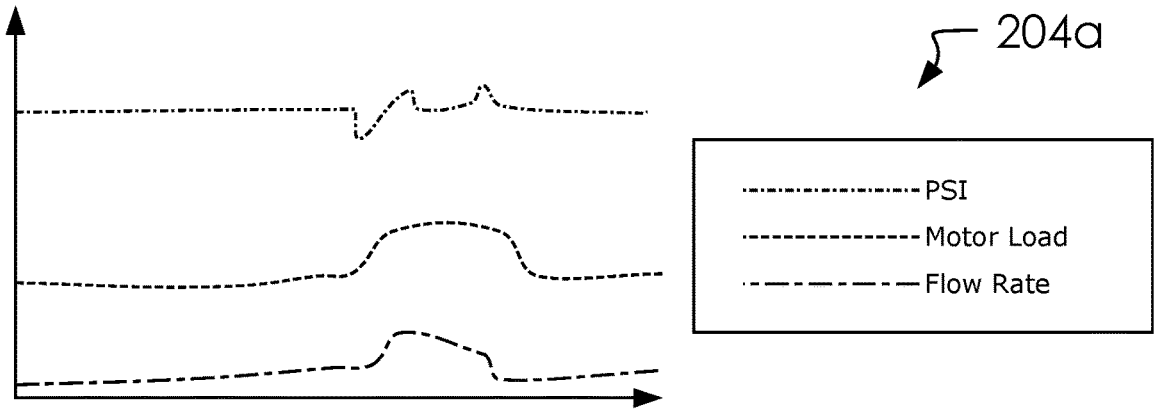
FIGS. 2A, 2B and 2C illustrate a ramp up phase 204*a*, a maintain phase 204*b* and a ramp down phase 204*c* as managed by a power management system 202 within a controller 104 and a device application 200.
Figure 2B:
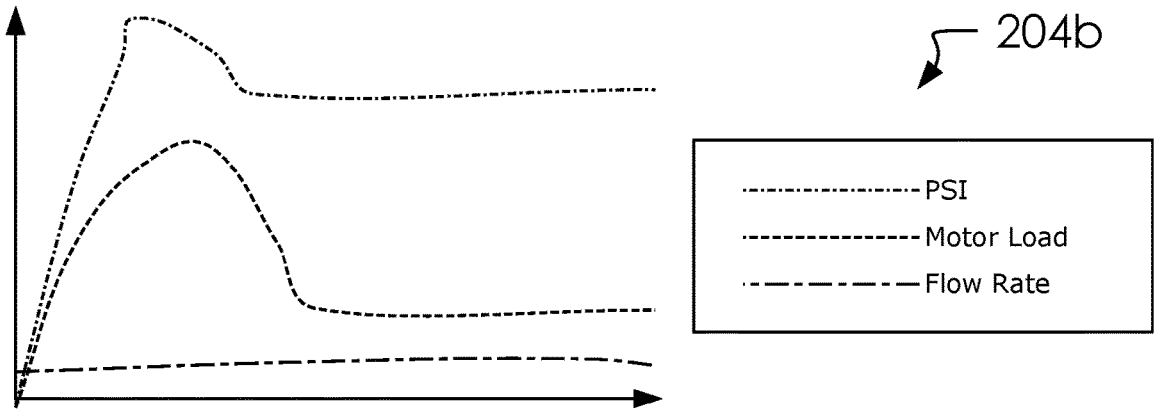
Figure 2C:
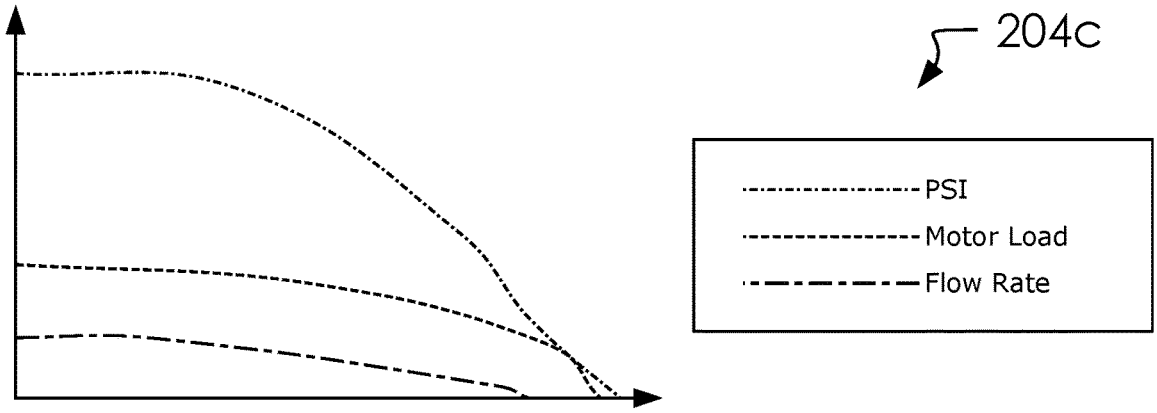

FIGS. 2A, 2B and 2C illustrate a ramp up phase 204*a*, a maintain phase 204*b* and a ramp down phase 204*c* as managed by a power management system 202 within said controller 104 and a device application 200.

In one embodiment, said air intake 106 can comprise said device application 200 which can comprise said power management system 202. In one embodiment, said power management system 202 can manage a motor workload 214 on said electric motor 110 in relation to an air pressure 210 and an air flow rate 212 of said compressed air 126 from said variable air compressor assembly 100.

In one embodiment, said power management system 202 can monitor said air pressure 210, said air flow rate 212 and said motor workload 214 to determine how to adjust said motor workload 214 in anticipation of further needs in said air flow rate 212 and said motor workload 214. Furthermore, said motor workload 214 can comprise an RPM of said electric motor 110 and a gear ratio between said compressor 108 and said electric motor 110.

Figure 3:
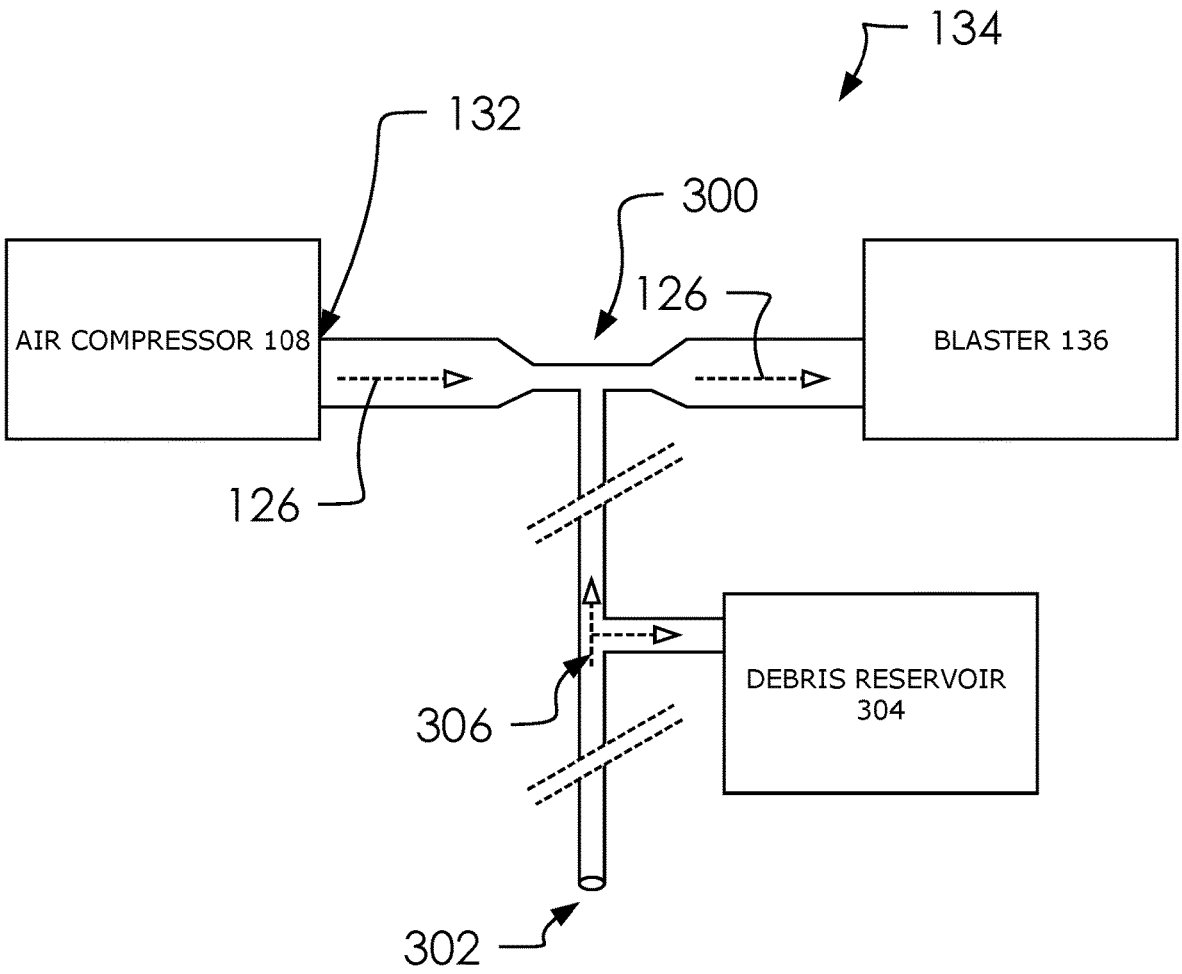
FIG. 3 is a schematic representation of a vacuum assembly 134, including a venturi configuration 300, a suction nozzle 302, and a debris reservoir 304.

FIG. 3 is a schematic representation of said vacuum assembly 134, including a venturi configuration 300, a suction nozzle 302, and a debris reservoir 304.

In one embodiment, said venturi configuration 300 can be integrated between said air outlet 132 of said compressor 108 and said blasting system 136 to use a portion of said compressed air 126 to create a suction 306 using the Venturi effect, as is known in the art. In one embodiment, said suction 306 can pull debris from said suction nozzle 302 into said debris reservoir 304, as is known in the art.

Figure 4:
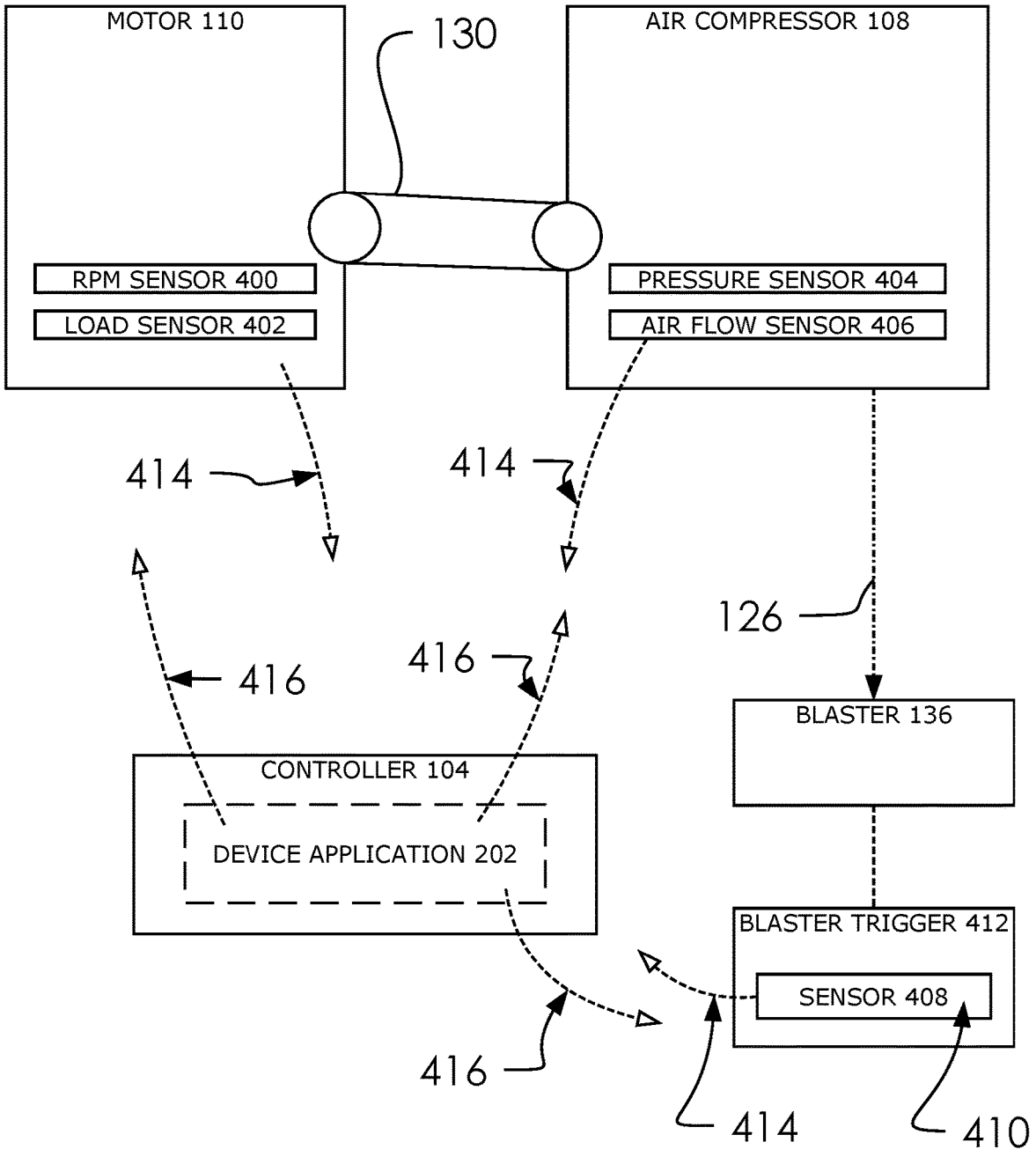
FIG. 4 is a diagram of the communication system between the components of said variable air compressor assembly 100.

FIG. 4 is a diagram of the communication system between the components of said variable air compressor assembly 100.

In one embodiment, said electric motor 110 can comprise an RPM sensor 400 configured to measure a rotations per minute of said electric motor 110 and a motor load sensor 402 configured to measure said motor workload 214 on said electric motor 110. Said compressor 108 can comprise a pressure sensor 404 configured to measure said air pressure 210 on said compressor 108 and an air flow sensor 406 configured to measure said air flow rate 212 on said compressor 108. In one embodiment, said blasting system 136 can comprise a trigger sensor 408 configured to measure a trigger input 410 on a blaster trigger 412 from said blasting system 136 configured to communicate a desired flow rate of said compressed air 126 out of said compressor 108. In one embodiment, said variable air compressor assembly 100 is configured to send a portion of a sensor data 414 to said device application 200 and said power management system 202 from said RPM sensor 400, said motor load sensor 402, said pressure sensor 404, said air flow sensor 406 and said trigger sensor 408.

In one embodiment, said device application 200 can generate a control signal 416 to manage the condition of said compressor 108, said electric motor 110, said belt drive assembly 130, and said blasting system 136.

Figure 5:
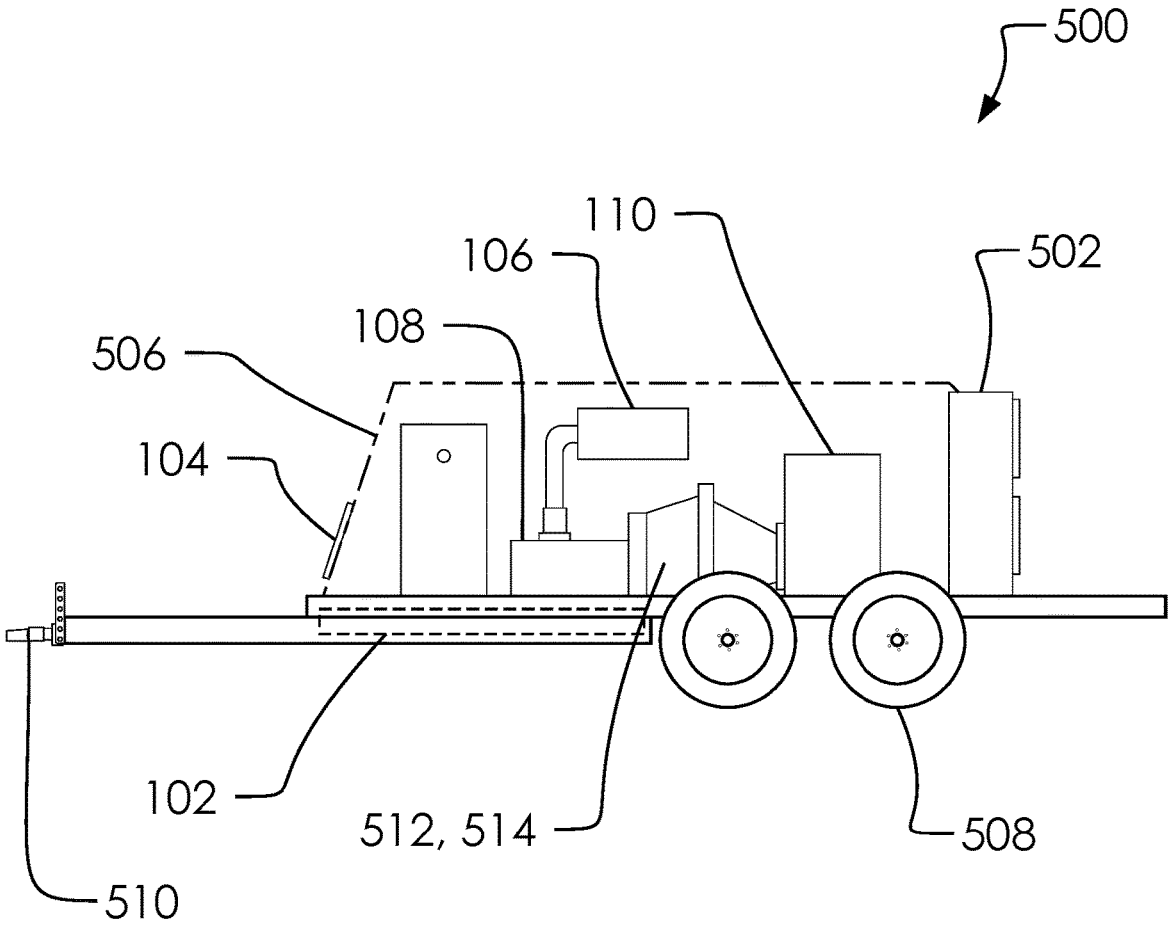
FIG. 5 illustrates an elevated side view of said variable air compressor assembly 100 on a trailer 500.

FIG. 5 illustrates an elevated side view of said variable air compressor assembly 100 on a trailer 500.

In one embodiment, said variable air compressor assembly 100 can be adapted to be attached to and managed on said trailer 500.

In one embodiment, said variable air compressor assembly 100 can comprise said belt drive assembly 130, as discussed above. In another embodiment, said variable air compressor assembly 100 can comprise a more traditional vehicle drivetrain attached to said electric motor 110. For example, said variable air compressor assembly 100 can comprise a cooling radiator 502, an oil reservoir 504, and a cover 506. In one embodiment, said trailer 500 can comprise a wheel assembly 508 and a hitch system 510.

Likewise, in one embodiment, said compressor 108 can be attached to said electric motor 110 using a coupler 512. In one embodiment, said coupler 512 can comprise a bell housing and a coupler configured to transfer rotational power from said electric motor 110 into said compressor 108 for selectively generating said compressed air 126 (illustrated below). In one embodiment, a gear box 514 can be used to modify said motor workload 214, as discussed at length above.

Figure 6:
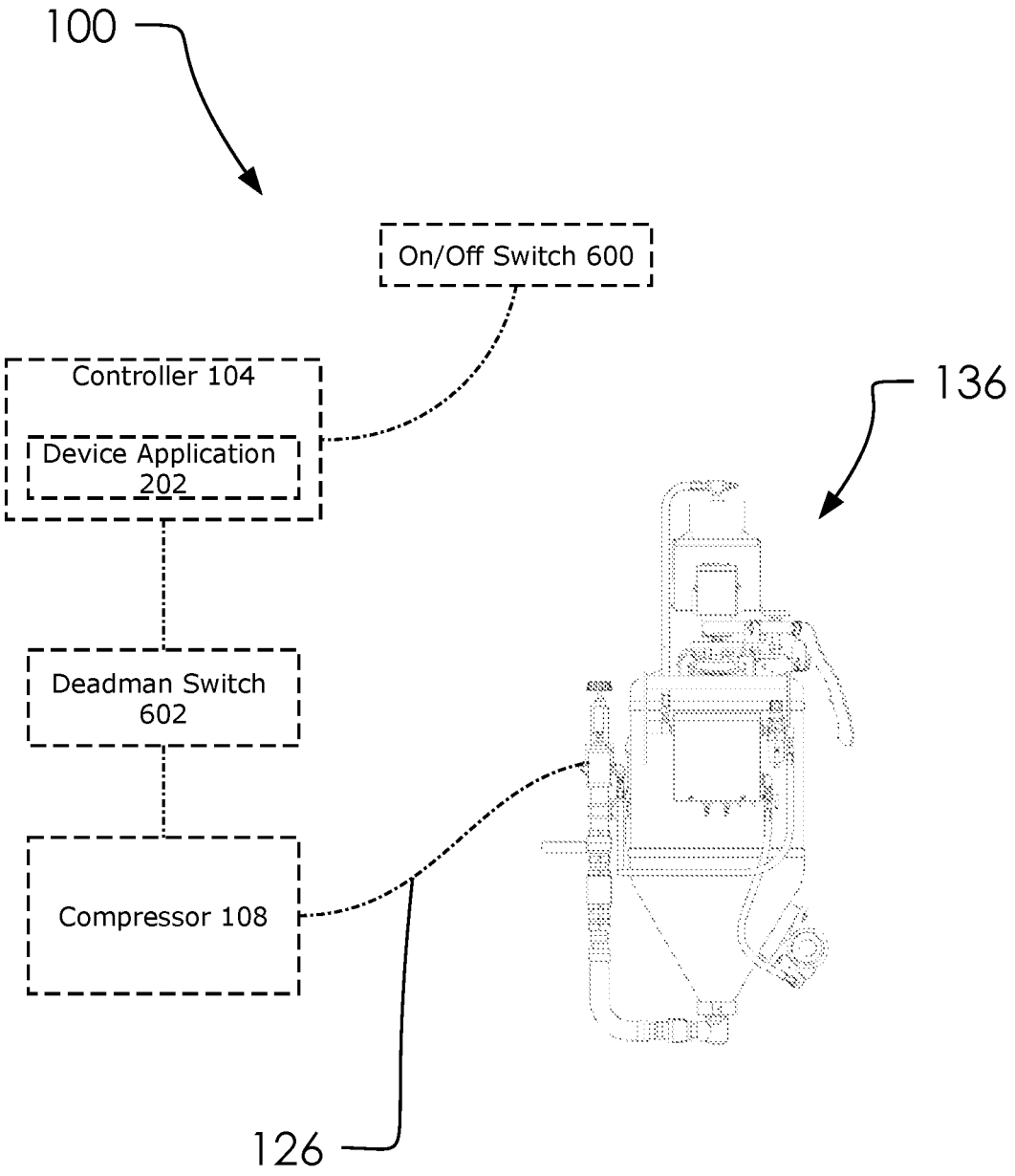
FIG. 6 illustrates a block diagram of said variable air compressor assembly 100 and an elevated side view of a blasting system 136.

FIG. 6 illustrates a block diagram of said variable air compressor assembly 100 and an elevated side view of said blasting system 136.

In one embodiment, said variable air compressor assembly 100 can further comprise said blasting system 136 and said controller 104. Said blasting system 136 can be similar to those cited above as incorporated by reference; viz., U.S. Pat. No. 11,285,580, 9,844,851, 9,849,560, 10,569,386, and 10,449,657.

Said controller 104 can comprise a computing system comprising said device application 200. Wherein, said controller 104 can receive signals from portions of said variable air compressor assembly 100, apply a protocol from said device application 200 to said signals and control portions of said variable air compressor assembly 100.

In one embodiment, said compressor 108 can comprise said compressed air 126 to said blasting system 136, as discussed in the filings incorporated by reference.

In one embodiment, by coupling said electric motor 110 to said compressor 108 using said coupler 512, said variable air compressor assembly 100 can be configured to reuse existing electrical motors, such as automotive EV motors to power said compressor 108.

In one embodiment, an automotive EV motor can be repurposed for said variable air compressor assembly 100 by programming said controller 104 to communicate with said electric motor 110 as though in use in a vehicle. Likewise, said battery 102 must be communicated with by said controller 104 to charge and discharge and preferred rates.

In one embodiment, said controller 104 can be configured to monitor RPM of said electric motor 110, production of said compressed air 126 by said compressor 108, output rates of said blasting system 136, and on/off signals of said blasting system 136; wherein, said controller 104 can ensure safe operation for workers and long life for components on said variable air compressor assembly 100. Examples of such concerns include cooling systems, fans, heat of the compressor, lubricants, charging rates, battery temperature.

In one embodiment, said battery 102 can comprise automotive EV batteries configured to provide substantial DC power. Whereby, said variable air compressor assembly 100 is configured to improve performance of said blasting system 136 when compared to plugging into the grid or a residential AC power source. This is because typical power outlets in the US do not provide three phase power sufficient to operate said compressor 108, whereas said battery 102 is able to achieve this threshold. In one embodiment, said variable air compressor assembly 100 can be configured to operate for 8 hours on a single charge, which is sufficient to enable an entire workday on one charge.

Likewise, said variable air compressor assembly 100 is configured to manage heat production. In one embodiment, said cooling radiator 502 can pull oil through portions of said variable air compressor assembly 100 to dissipate heat.

In one embodiment, said variable air compressor assembly 100 can comprise an on-off switch 600 and a deadman switch 602. In one embodiment, said on-off switch 600 can be a remote control, a digital signal, a failsafe button, or similar. In one embodiment, by engaging said on-off switch 600, said variable air compressor assembly 100 can activate and produce said compressed air 126 for said blasting system 136. Since said electric motor 110 can provide instantaneous torque, engaging said on-off switch 600 can provide power to said blasting system 136 much quicker than a gas powered compressor. Likewise, electric motors produce much less noise pollution than gas powered solutions.

In one embodiment, said deadman switch 602 can operate to disengage said compressor 108 and said electric motor 110 immediately, as desired by programming associated with said device application 200.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

I. Description of the First Embodiment

The first embodiment of said variable air compressor assembly 100 provides an innovative system for driving an said compressor 108 using an said electric motor 110 and a said belt drive assembly 130. Said variable air compressor assembly 100 is designed to generate variable speed and torque, thereby controlling the pressure (PSI) and flow rate of the air output from the said compressor 108.

In this arrangement, said electric motor 110, capable of producing varying speed and torque, connects to the said compressor 108 via a said belt drive assembly 130. Said electric motor 110, responding to a control signal, adjusts its rotational speed and torque to drive the belt and, subsequently, the said compressor 108.

The said belt drive assembly 130 serves as a transmission interface between the said electric motor 110 and the said compressor 108. The design and material of the belt, along with the pulley size, contribute to translating the motor's speed and torque effectively to the said compressor 108, providing precise control over the PSI and flow rate of the air output. Said belt drive assembly 130 can comprise a CVT transmission, a gear selector and derailer configuration or similar, as would be obvious to one in the art.

Incorporated in this embodiment is said power management system 202 tasked with generating said control signal 416. The module takes input parameters corresponding to the desired PSI and flow rate of the air output, for example said RPM sensor 400, said motor load sensor 402, said pressure sensor 404, said air flow sensor 406 and said trigger sensor 408. Said power management system 202 in said device application 200 are configured to leverage advanced control algorithms to determine the required speed and torque of the said electric motor 110, and converts these parameters into a corresponding control signal. This signal instructs the said electric motor 110 to operate at the necessary speed and torque, thus achieving the desired PSI and flow rate from the said compressor 108.

One strength of this embodiment lies in the simplicity and cost-effectiveness offered by the said belt drive assembly 130 system, as well as the ability to adjust the speed and torque of said belt drive assembly 130 for precise control over an output of said compressor 108. This allows the said electric motor 110 to operate efficiently, enhancing the overall energy efficiency and reducing wear on the system, thus extending its lifespan.

This invention presents a method and system for driving said compressor 108 with variable speed and torque using said electric motor 110 and said belt drive assembly 130. However, the specific configurations and arrangements can differ based on the requirements of the application, and therefore can be modified and altered without deviating from the scope and spirit of the present invention.

While the above describes the preferred embodiment of the present invention, alterations and modifications will be apparent to those of ordinary skill in the art. Such alterations and modifications are intended to fall within the scope of the appended claims.

II. Description of the Second Embodiment

In a second embodiment of said variable air compressor assembly 100, an improved drive system for said compressor 108 is provided. This system utilizes said electric motor 110 interfaced with said gear box 514, offering the ability to drive the said compressor 108 at variable speeds and torque, thereby adjusting the pressure (PSI) and flow rate of the air output.

Said electric motor 110, characterized by its capabilities to generate variable speeds and torque, connects to a gear box via an input shaft. The gear box, configured with a suitable set of gears, links to the said compressor 108 through an output shaft. The said electric motor 110, in response to said control signal 416, adjusts its rotational speed and torque.

In this configuration said gear box 514 serves as a mechanical interface between the said electric motor 110 and the said compressor 108. Said gear box 514 comprises a series of gears designed to translate the motor's rotational speed and torque effectively to the said compressor 108, thereby allowing precise control over the PSI and flow rate of the air output.

This embodiment incorporates said power management system 202 responsible for generating said control signal 416. The module receives input parameters related to the desired PSI and flow rate of the air output. The control module uses advanced control algorithms to calculate the required speed and torque of the said electric motor 110, which are then converted into an appropriate control signal. This signal commands the said electric motor 110 to operate at the calculated speed and torque, thereby achieving the desired PSI and flow rate from the said compressor 108.

The advantage of this embodiment lies in the enhanced torque range offered by the gear box, which facilitates improved control over the an output of said compressor 108. Said electric motor 110 can operate at optimal speeds while the gear box ensures efficient power transfer to the said compressor 108. This design yields greater energy efficiency and reduced wear on the said electric motor 110, extending its operational life.

The present invention discloses a method and system for driving said compressor 108 with variable speed and torque using an said electric motor 110 and gear box. However, the specific configurations and designs may vary based on application requirements and are thus subject to modifications and changes without departing from the scope and spirit of the present invention.

While the foregoing describes the preferred embodiment of the present invention, alterations and modifications will be apparent to those skilled in the art. Such alterations and modifications are intended to fall within the scope of the appended claims.

III. Description of the Third Embodiment

In another embodiment of said variable air compressor assembly 100, said electric motor 110 employed in said compressor 108 is an axial flux motor. Axial flux motors, also known as pancake motors, present a unique advantage in their design where the magnetic flux flows along the axis of the rotor, unlike in traditional radial flux motors where the flux flows radially from the center of the motor to its periphery.

This arrangement results in a more efficient transfer of energy and allows for a lighter, more compact design. The disc-like structure of axial flux motors enables greater torque and power density, which is advantageous for the drive system of said compressor 108. This design also enhances heat dissipation due to the increased surface area, thus leading to improved motor longevity.

The axial flux motor in this embodiment can generate variable speed and torque, which are critical for the operation of said compressor 108. The motor's performance characteristics, coupled with its compact design and energy efficiency, make it an ideal choice for this application.

The following is a listing of the parts in this disclosure:

said variable air compressor assembly 100,
said battery 102,
said controller 104,
said air intake 106,
said compressor 108,
said electric motor 110,
said generator 128,
said belt drive assembly 130,
said air outlet 132,
said vacuum assembly 134,
said blasting system 136,
said power source 136,
said compressed air 126,
said ramp up phase 204*a*,
said maintain phase 204*b*,
said ramp down phase 204*c*,
said power management system 202,
said device application 200,
said motor workload 214,
said air pressure 210,
said air flow rate 212,
said venturi configuration 300,
said suction nozzle 302,
said debris reservoir 304,
said suction 306,
said RPM sensor 400,
said motor load sensor 402,
said pressure sensor 404,
said air flow sensor 406,
said trigger sensor 408,
said trigger input 410,
said blaster trigger 412,
said of a sensor data 414, said control signal 416,
said trailer 500,
said cooling radiator 502,
said oil reservoir 504,
said cover 506,
said wheel assembly 508,
said hitch system 510,
said coupler 512,
said gear box 514,
said on-off switch 600,
said deadman switch 602.

One preferred embodiment can be characterized by the original claims as follows.

Said variable air compressor assembly 100 for selectively generating said compressed air 126 with said compressor 108 and said electric motor 110 while monitoring said RPM sensor 400, said motor load sensor 402, said pressure sensor 404 and said air flow sensor 406 and modifying said control signal 416 for said compressor 108, said electric motor 110 and said belt drive assembly 130 can comprise said variable air compressor assembly 100 comprises said controller 104, said air intake 106, said compressor 108, said electric motor 110, said belt drive assembly 130, said air outlet 132, said power source 136 and said device application 200. Said device application 200 receives said of a sensor data 414 from a portion of said RPM sensor 400, said motor load sensor 402, said pressure sensor 404 and said air flow sensor 406 and generates said control signal 416 to control said compressor 108, said electric motor 110 and said belt drive assembly 130 according to said power management system 202 in said device application 200. Said power source 136 can be connected to said electric motor 110 and provides necessary power for operation of said variable air compressor assembly 100. Said compressor 108 mechanically connected to said electric motor 110 with said belt drive assembly 130 and configured to output said compressed air 126. Wherein, said variable air compressor assembly 100 can be configured to selectively adjust the volume and pressure of the air output by modulating a power input from the said electric motor 110 to the said compressor 108 based on the input parameters, the modulation achieved through adjustments in the speed and torque of said electric motor 110 as commanded by said software controller application within the controller.

Said variable air compressor assembly 100 for selectively generating said compressed air 126 with said compressor 108 and said electric motor 110 while monitoring said RPM sensor 400, said motor load sensor 402, said pressure sensor 404 and said air flow sensor 406 and modifying said control signal 416 for said compressor 108, said electric motor 110 and said belt drive assembly 130 can comprise said variable air compressor assembly 100 comprises said controller 104, said air intake 106, said compressor 108, said electric motor 110, said belt drive assembly 130, said air outlet 132, said power source 136 and said device application 200. Said device application 200 receives said of a sensor data 414 from a portion of said RPM sensor 400, said motor load sensor 402, said pressure sensor 404 and said air flow sensor 406 and generates said control signal 416 to control said compressor 108, said electric motor 110 and said belt drive assembly 130 according to said power management system 202 in said device application 200. Said power source 136 can be connected to said electric motor 110 and provides necessary power for operation of said variable air compressor assembly 100. Said compressor 108 mechanically connected to said electric motor 110 with said belt drive assembly 130 and configured to output said compressed air 126. Wherein, said variable air compressor assembly 100 can be configured to selectively adjust the volume and pressure of the air output by modulating a power input from the said electric motor 110 to the said compressor 108 based on the input parameters, the modulation achieved through adjustments in the speed and torque of said electric motor 110 as commanded by said software controller application within the controller.

Said blasting system 136 connected to the output of the said variable air compressor assembly 100 to receive a portion of said compressed air 126. Said blasting system 136 further comprising said blaster trigger 412 having said trigger sensor 408 for sensing a state of said blaster trigger 412. Said blaster trigger 412 configured with multiple settings reflecting operational parameters of said blasting system 136. Said of a sensor data 414 of said trigger sensor 408 of said blaster trigger 412 can be communicated back to said device application 200. Wherein upon reception of said of a sensor data 414 of said trigger sensor 408, said device application 200 can be configured to dynamically modify said air pressure 210 and said air flow rate 212 of said compressor 108 by modifying a portion of said belt drive assembly 130, an RPM, and a torque on said electric motor 110. Said air pressure 210 and said air flow rate 212 of said compressed air 126 from the said compressor 108 can be configured by said device application 200 to comply with the operational parameters as specified by said device application 200.

Said pressure sensor 404 configured to measure the pressure (PSI) of the said compressed air 126 from said compressor 108. Said air flow sensor 406 configured to measure the flow rate of the said compressed air 126 from said compressor 108. Wherein, the measurements from said pressure sensor 404 and said pressure sensor 404 can be fed back to said controller 104 to facilitate real-time adjustments of the speed and torque of said electric motor 110, thereby achieving precise control over the pressure and flow rate of the air output.

Said battery 102 serving as said power source 136 for the said electric motor 110, thereby enabling portable operation of the said variable air compressor assembly 100 and providing flexibility in its applications.

The said variable air compressor assembly 100 further comprises of the said variable air compressor assembly 100 can be configured to receive alternating current (AC) from a source selected among an external power grid or an electric generator.

Said power source 136 comprises a hybrid power source including said battery 102 and said generator 128. Said power management system 202 within said device application 200 of said controller 104 configured to monitor the charge level of the battery pack and the power requirements of the said electric motor 110. Wherein, based on the monitoring, said device application 200 selectively commands the electric generator to recharge the battery pack when necessary, thereby ensuring uninterrupted operation and optimizing power utilization of the said variable air compressor assembly 100.

Said device application 200 further comprises a power source selector that can switch the system between AC and DC power sources. Said power management system 202 can be configured to analyze factors such as desired heat dissipation and speed/torque performance of said electric motor 110, and choose a power source can be based on such factors and thereby optimizing the operation of the said variable air compressor assembly 100 under varying operational conditions and requirements.

Said variable air compressor assembly 100 comprises an axial flux motor characterized by its compact design, efficient energy transfer, enhanced heat dissipation, and ability to generate variable speed and torque.

Said variable air compressor assembly 100 further comprises said vacuum assembly 134 configured to generate suction by directing a portion of said compressed air 126 from said air outlet 132 of said compressor 108 across said venturi configuration 300, thereby creating a pressure differential and inducing said suction 306. Said suction 306 used to pull debris from said suction nozzle 302 into said debris reservoir 304. Wherein, this integration of said vacuum assembly 134 enhances the functionality of the said variable air compressor assembly 100, enabling it to function not only as an air supply system but also as a cleaning apparatus.

Said power management system 202 within said controller 104, configured to adjust the consumption of power and power ratios between the said electric motor 110 and the said compressor 108 based on the operational phase of the system, the operational phases being said ramp up phase 204*a*, said maintain phase 204*b* and said ramp down phase 204*c*. Wherein, during said ramp up phase 204*a*, said power management system 202 allocates more power to the said electric motor 110 to quickly achieve the desired speed and torque. During said maintain phase 204*b*, said power management system 202 balances the power between the said electric motor 110 and the said compressor 108 based on the stable power demands. During said ramp down phase 204*c*, said power management system 202 reduces power to the said electric motor 110 gradually to bring the system to a stop, thereby minimizing wear on the components. Wherein, the operational phase can be manually set in said controller 104 or programmatically set based on usage patterns detected by said controller 104, thus enhancing the efficiency, sustainability, and lifespan of the said variable air compressor assembly 100.

A method for controlling said compressor 108, the method comprising the steps of: providing said variable air compressor assembly 100 comprising said electric motor 110, a power source, said compressor 108, and a controller integrated with a software controller application. Receiving input parameters related to a desired volume and pressure of the air output from a user or system. Modulating a power input from the said electric motor 110 to the said compressor 108 based on the input parameters, the modulation achieved through adjustments in the speed and torque of the said electric motor 110 as commanded by the software controller application within said controller 104. Thereby selectively adjusting the volume and pressure of the air output from the said compressor 108 assembly.

Attaching the output of said variable air compressor assembly 100 to an air intake of said blasting system 136. Communicating said of a sensor data 414 from said blaster trigger 412 of said blasting system 136 back to said controller 104. Modifying the pressure (PSI) and air flow rate of the air output from the said variable air compressor assembly 100 in response to the communicated trigger settings.

Incorporating said pressure sensor 404 and said air flow sensor 406 into said variable air compressor assembly 100. Measuring said air pressure 210 and said air flow rate 212 of said compressed air 126 using said pressure sensor 404 and said air flow sensor 406, respectively. Feeding back the measurements said pressure sensor 404 and said air flow sensor 406 to said controller 104. Adjusting the speed and torque of the said electric motor 110 based on the feedback, thereby achieving precise control over the pressure and flow rate of the air output.

The invention claimed is:

1. A variable air compressor assembly for selectively generating a compressed air with a compressor and an electric motor while monitoring an RPM sensor, a motor load sensor, a pressure sensor and an air flow sensor and modifying a control signal for said compressor, said electric motor and a belt drive assembly, comprising:

a controller, an air intake, said compressor, said electric motor, said belt drive assembly, an air outlet, a power source and a device application;

said device application receives sensor data from one or more sensors selected from the group consisting of said RPM sensor, said motor load sensor, said pressure sensor and said air flow sensor;

said device application generates said control signal to control said compressor, said electric motor and said belt drive assembly according to a power management system in said device application;

said power source is connected to said electric motor and provides necessary power for operation of said variable air compressor assembly;

said compressor is mechanically connected to said electric motor with said belt drive assembly and configured to output said compressed air; and wherein, said variable air compressor assembly is configured to selectively adjust a volume and a pressure of the compressed air by modulating a power input from said electric motor to said compressor based on input parameters, the modulation being achieved through adjustments in a speed and a torque of said electric motor as commanded by said device application within the controller.

2. The variable air compressor assembly of claim 1, further comprising:

a blasting system connected to an output of the variable air compressor assembly to receive a portion of said compressed air;

said blasting system further comprising a blaster trigger having a trigger sensor for sensing a state of said blaster trigger;

said blaster trigger configured with multiple settings reflecting operational parameters of said blasting system; and said sensor data of said trigger sensor of said blaster trigger are communicated back to said device application;

wherein upon reception of said sensor data of said trigger sensor, said device application is configured to dynamically modify said volume and said pressure of the compressed air of said compressor by modifying an RPM of said electric motor; and said pressure and said volume of said compressed air from the compressor are configured by said device application to comply with the operational parameters of the blasting system as specified by said device application.

3. The variable air compressor assembly of claim 1, wherein:

said pressure sensor is configured to measure the pressure of the compressed air from said compressor;

said air flow sensor is configured to measure the flow rate of the compressed air from said compressor; and wherein, the measurements from said pressure sensor are fed back to said controller to facilitate real-time adjustments of the speed and torque of said electric motor, thereby achieving precise control over the pressure and flow rate of the compressed air.

4. The variable air compressor assembly of claim 1, further comprises:

a battery serving as said power source for the electric motor, thereby enabling portable operation of the variable air compressor assembly and providing flexibility in its applications.

5. The variable air compressor assembly of claim 1, wherein:

the variable air compressor assembly is configured to receive alternating current from a source selected among an external power grid and an electric generator.

6. The variable air compressor assembly of claim 1, wherein:

said power source comprises a hybrid power source including a battery and a generator;

said power management system within said device application of said controller is configured to monitor a charge level of the battery and power requirements of the electric motor; and wherein, based on the monitoring, said device application selectively commands the electric generator to recharge the battery when necessary, thereby ensuring uninterrupted operation and optimizing power utilization of the variable air compressor assembly.

7. The variable air compressor assembly of claim 6, wherein:

said device application further comprises a power source selector configured to select between an AC power and a DC power;

said power management system is configured to analyze one or more factors selected from a list consisting of a desired heat dissipation, a speed of said electric motor, and a torque ~~performance~~ of said electric motor;

said power management system is further configured to choose a power source based on the one or more factors and to thereby optimize the operation of the variable air compressor assembly under varying operational conditions and requirements.

8. The variable air compressor assembly of claim 1, further comprising:

said variable air compressor assembly comprises an axial flux motor.

9. The variable air compressor assembly of claim 1, wherein:

said variable air compressor assembly further comprises a vacuum assembly configured to generate suction by directing a portion of said compressed air from said air outlet of said compressor across a venturi configuration, thereby creating a pressure differential and inducing a suction;

said suction used to pull debris from a suction nozzle into a debris reservoir;

wherein, said vacuum assembly enhances the functionality of the variable air compressor assembly, enabling it to function not only as an air supply system but also as a cleaning apparatus.

10. The variable air compressor assembly of claim 1, wherein:

said power management system is within said controller, and is configured to adjust the consumption of power and power ratios between the electric motor and the compressor based on operation phases of the variable air compressor assembly, the operational phases being a ramp up phase, a maintain phase and a ramp down phase;

wherein, during said ramp up phase, said power management system is configured to allocate more power to the electric motor to optimize said speed and said torque;

during said maintain phase, said power management system balances the power between the electric motor and the compressor;

during said ramp down phase, said power management system reduces power to the electric motor gradually to bring the variable air compressor assembly to a stop, thereby minimizing wear on one or more components of said variable air compressor assembly; and wherein, the operational phase is manually set in said controller or programmatically set based on usage patterns detected by said controller, thus enhancing the efficiency, sustainability, and lifespan of the variable air compressor assembly.

11. A method for controlling a variable air compressor assembly, the method comprising the steps of:

providing said variable air compressor assembly comprising a controller, an air intake, a compressor, an electric motor, a belt drive assembly, an air outlet, a power source, and a device application;

receiving, at the device application, sensor data from one or more sensors selected from the group consisting of an RPM sensor, a motor load sensor, a pressure sensor, and an air flow sensor;

generating, with the device application, a control signal based on the received sensor data according to a power management system in the device application;

supplying power from the power source to the electric motor;

mechanically driving the compressor with the electric motor via the belt drive assembly to output compressed air;

selectively adjusting a volume and a pressure of the compressed air by modulating a power input from the electric motor to the compressor based on user or system input parameters, the modulation being achieved through adjustments in a speed and a torque of the electric motor as commanded by the device application within the controller;

attaching an output of the variable air compressor assembly to an air intake of a blasting system;

sensing, with a trigger sensor of a blaster trigger, a state of the blaster trigger;

communicating sensor data from the trigger sensor to the device application; and dynamically modifying, with the device application, at least one of: the belt drive assembly, a speed of the electric motor, and a torque of the electric motor, thereby adjusting the pressure and volume of the compressed air in accordance with operational parameters of the blasting system.

* * * * *